United States Patent [19]

Borja

[11] Patent Number: 4,988,965

[45] Date of Patent: Jan. 29, 1991

[54] REED SWITCH HOLDER ASSEMBLY

[75] Inventor: Jesus Borja, Glenview, Ill.

[73] Assignee: The Chamberlain Group, Inc., Elmhurst, Ill.

[21] Appl. No.: 499,000

[22] Filed: Mar. 26, 1990

[51] Int. Cl.[5] ..... H01H 9/00

[52] U.S. Cl. ..... 335/205; 335/202

[58] Field of Search ..... 335/205-207, 335/202; 200/293, 294, 295

[56] References Cited

U.S. PATENT DOCUMENTS

| | | | |
|---|---|---|---|
| 3,204,058 | 8/1965 | Barton . | |
| 3,302,143 | 1/1967 | Harkenrider . | |
| 3,483,492 | 12/1969 | Mirbeth . | |
| 3,539,956 | 11/1970 | Andersen et al. . | |
| 3,838,213 | 9/1974 | Georgopulos et al. . | |
| 4,005,295 | 1/1977 | Mitchell et al. . | |
| 4,032,871 | 6/1977 | Sauer . | |
| 4,136,321 | 1/1979 | Smith . | |
| 4,227,163 | 10/1980 | Barnoski | 335/205 |
| 4,335,270 | 6/1982 | Holce et al. . | |
| 4,343,451 | 8/1982 | Armstrong . | |
| 4,371,856 | 2/1983 | Holce et al. . | |
| 4,409,577 | 10/1983 | Holce et al. | 335/205 |
| 4,507,708 | 3/1985 | Lindberg . | |
| 4,567,546 | 1/1986 | Zeller et al. . | |
| 4,588,854 | 5/1986 | Bailey et al. . | |
| 4,613,925 | 9/1986 | Mohri et al. . | |
| 4,618,915 | 10/1986 | Bury . | |
| 4,667,270 | 5/1987 | Yagi . | |
| 4,725,922 | 2/1988 | Matsuoka . | |
| 4,821,152 | 4/1989 | Lorenzen . | |

*Primary Examiner*—Leo P. Picard
*Assistant Examiner*—L. Donovan
*Attorney, Agent, or Firm*—Fitch, Even, Tabin & Flannery

[57] ABSTRACT

A reed switch holder assembly for detecting the passage of a magnet adjacent the assembly. The assembly includes a reed switch and first and second terminal elements each including a lead-receiving ferrule and a portion for mechanical and electrical connection to a conductor. The ferrule has a spring finger for holding a lead of the reed switch which finger includes a portion extending transversely from the remainder of the ferrule. The reed switch holder of the assembly includes a base of one-piece molded thermoplastic construction and a cover of one-piece molded thermoplastic construction. The base and cover include a latching mechanism for holding the base and cover assembly which, in their assembled condition, define a central cavity for holding the envelope of the reed switch and a pair of side cavities for receiving the leads of the reed switch and the ferrules of the terminal elements. One side cavity extends to a first end of the holder and the other side cavity extends to the holder second end. The holder also has a window extending transversely from each side cavity for holding the finger portion of the corresponding ferrule. The holder also includes a mount for attaching the assembly to a mounting wall.

11 Claims, 2 Drawing Sheets

REED SWITCH HOLDER ASSEMBLY

This invention relates to holders for discrete electrical components and, more particularly, to a holder for a reed switch and terminal elements for connection to the leads of the reed switch.

BACKGROUND OF THE INVENTION

Reed switches are commonly employed for sensing the position of a mechanism the movement of which is to be monitored, by providing a switched output in response to the passage or approach of an actuating magnet carried by the mechanism. For example, a reed switch can be used to monitor the position of a garage door by placing the reed switch for actuation by a magnet carried by the shaft of the motor of a garage door opener mechanism which moves the garage door between its open and closed positions. The reed switch can be a component of a shaft encoder assembly the output of which can be used to determine if the door has been stopped short of its closed position indicating the door has engaged an obstruction, or if the door has reached an up or down limit position so that the electrical power to the motor should be interrupted allowing the door to coast to its final position to avoid a high mechanical impact.

Appropriate mounting of a reed switch has presented difficulties because the glass envelope in which the metallic reeds are disposed is fragile. These envelopes are manufactured with both circular and rectangular cross sections. The glass envelopes are susceptible to damage unless adequately supported in a reed switch housing. As the reed switch and its holder are often assembled by the consumer of apparatus such as a garage door opener, it is always desirable that the assembly be simplified and that the completion of electrical connections to the leads of the reed switch be as easy as possible.

U.S. Pat. No. 4,335,270 to Holce et al. shows a one-piece plastic reed switch housing having a hinge at one end for holding a cover. The cover has a catch having an opening for snapping over a protuberance at the end of the housing not carrying the hinge. Both the leads of the switch extend from the same end of the housing, the end having the hinge.

U.S. Pat. No. 4,409,577 to Holce et al. shows a similar reed switch holder structure having a hinge for the cover at one end of the base. The housing carries a pair of spaced termination clamps positioned adjacent the ends of the base for use in connecting the leads of the reed switch to external conductors. U.S. Pat. No. 4,371,856 to Holce et al. discloses yet another reed switch holder, this time with structure permitting the electrical testing of the contained reed switch.

U.S. Pat. No. 3,838,213 to Georgopulos et al. depicts a case for holding a discrete electrical component. The case is formed of two halves connected by side hinges and with latching components at the other side of each half. The specific use indicated for the case is for holding loading coils for telephone circuits.

SUMMARY OF THE INVENTION

Among the several aspects and features of the present invention may be noted the provision of an improved holder for a reed switch and terminals electrically connected to the leads of the reed switch. The holder adequately supports a reed switch having an envelope of either circular or rectangular cross section. The terminal elements can be firmly retained by the holder prior to their connection to insulated conductors for connection to other electrical components. Alternatively the holder can receive the terminal elements after they have been connected to the conductors and after the holder has been assembled firmly holding the reed switch. The holder is of one-piece molded thermoplastic construction so that the assembler need not keep track of many loose holder parts. The reed switch holder of the present invention has long service life, is simple to use, and is relatively simple and economical to manufacture. Other aspects and features of the holder will be in part apparent and in part pointed out specifically in the following specification and accompanying drawings.

Briefly, the reed switch holder assembly includes a reed switch with an elongate insulative envelope in which are positioned first and second reeds. The switch also has a first end electrically connected to the first reed and extending beyond one end of the envelope, and a second lead connected to the second reed and extending from the other end of the envelope. First and second metallic terminal elements are provided each of which includes a lead-receiving ferrule and a portion for mechanical and electrical connection to a conductor. The ferrule has a spring finger for holding a lead and the finger has a portion extending transversely from the remainder of the ferrule. The assembly further includes a reed switch holder having a first end and a second end and including a base of one-piece molded thermoplastic construction and a cover of one-piece molded thermoplastic construction. The base and cover include a latching mechanism for holding the base and cover assembled, with the base and cover in their assembled condition defining a central cavity for holding the envelope, and a pair of side cavities for receiving the leads and the reed-receiving ferrules of the terminal elements. One side cavity extends to the holder first end and the other side cavity extends to the holder second end. A window is also provided extending transversely from each side cavity for holding the extending finger portion of the corresponding ferrule. Additionally, the holder includes a mounting means for attaching the assembly to a support. After the base and cover are latched to hold the switch, the ferrule of the one terminal element can be inserted into the one side cavity so that its spring finger holds its corresponding lead and insertion continued until the finger portion is received and held by the corresponding window. The second terminal element is similarly mounted in the holder.

BRIEF DESCRIPTION OF THE DRAWINGS

Corresponding reference numerals indicate corresponding components through out the several views of the drawings.

DESCRIPTION OF THE PREFERRED EMBODIMENT

Figure 1:
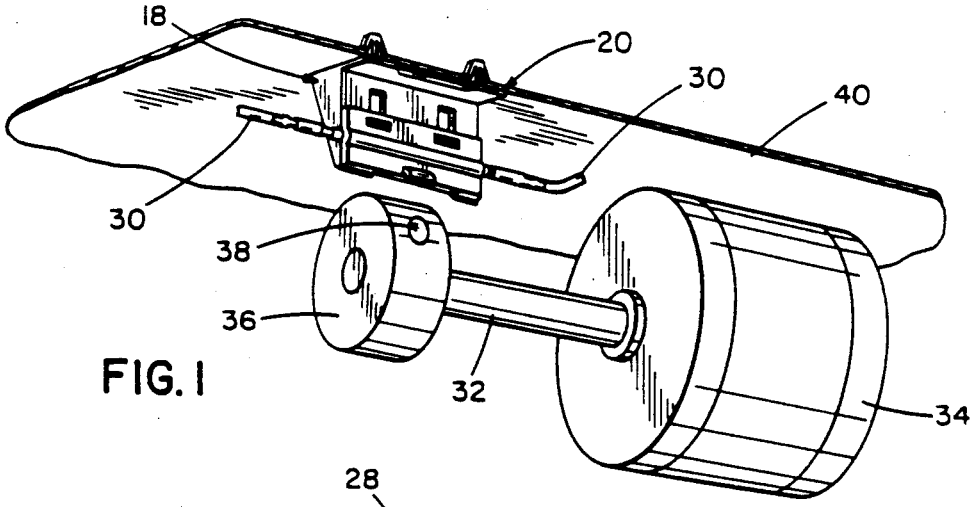
FIG. 1 is a perspective view of a reed switch holder embodying various aspects of the present invention holding a reed switch for sensing the passage of a magnet carried by the shaft of a motor.
Figure 2:
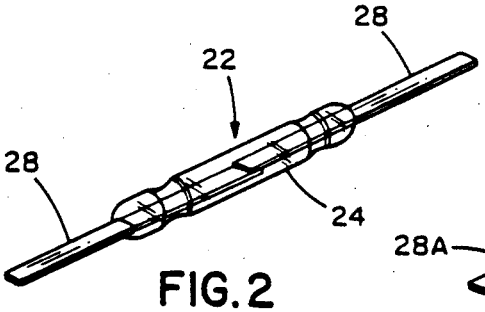
FIG. 2 is a perspective view of a reed switch having an envelope with a generally round cross section.
Figure 3:
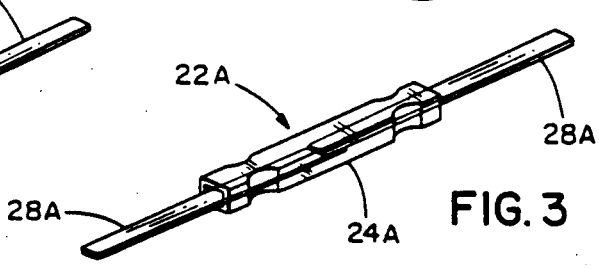
FIG. 3 is a perspective view of a reed switch having an envelope with a generally rectangular cross section.
Figure 4:
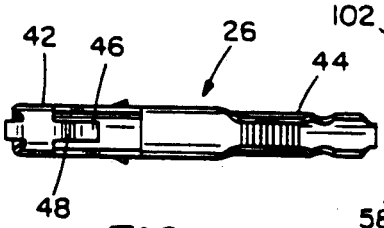
FIG. 4 is a plan view of a terminal element suitable for use with the reed switch holder of FIG. 1.
Figure 5:
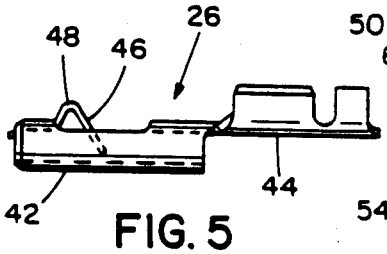
FIG. 5 is a side elevational view of the terminal element of FIG. 4.
Figure 6:
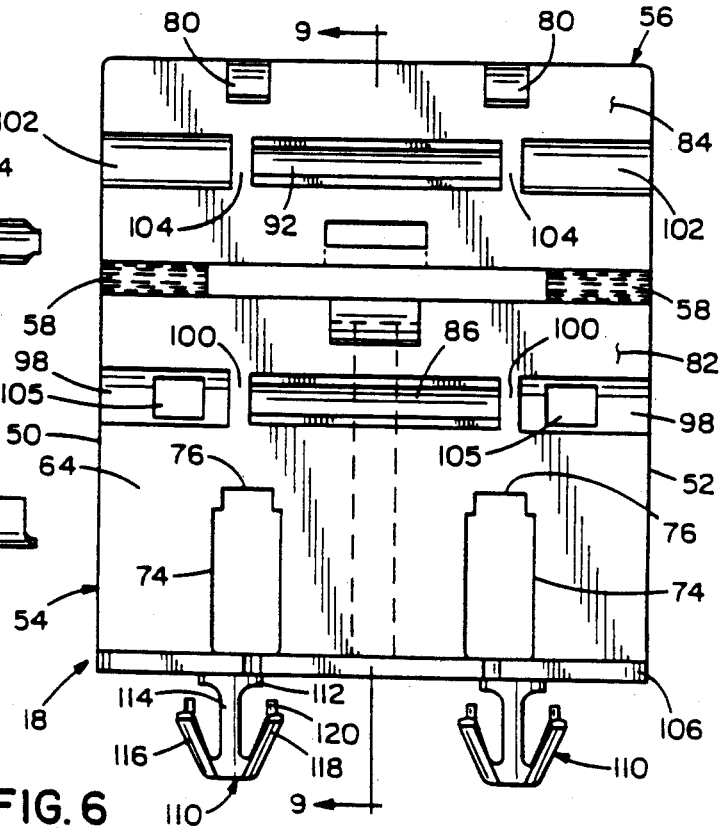
FIG. 6 is a front elevational view of the reed switch holder in its as-molded condition.
Figure 7:
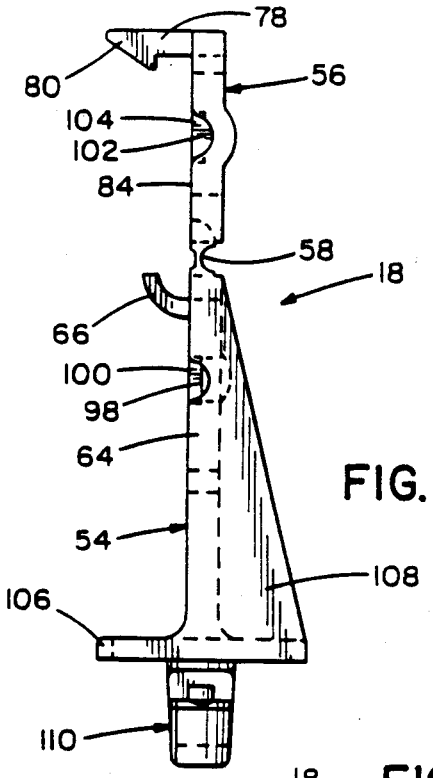
FIG. 7 is a side elevational view of the reed switch holder.
Figure 9:
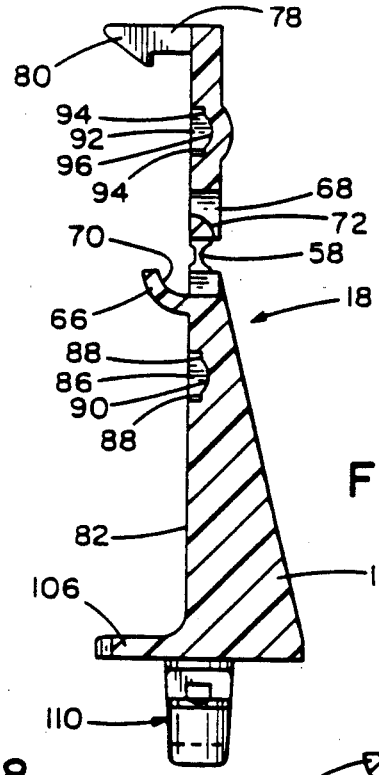
FIG. 9 is a cross-sectional view of the reed switch holder taken generally along line 9—9 of FIG. 6.
Figure 8:
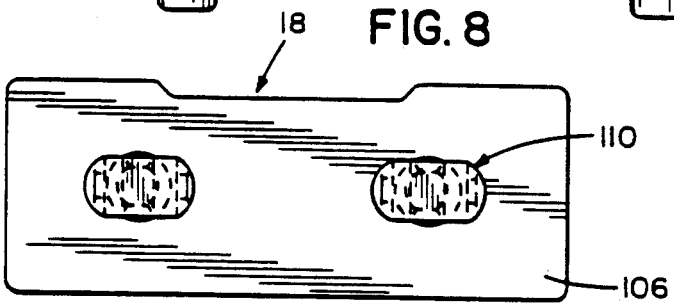
FIG. 8 is a bottom elevational view of the reed switch holder.
Figure 11:
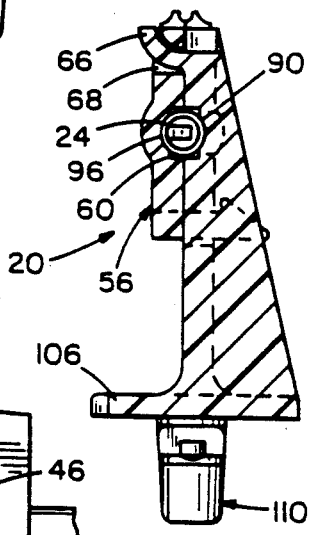
FIG. 11 is a cross-sectional view of the holder assembly of FIG. 10 taken generally along line 11—11 of FIG. 10.
Figure 10:
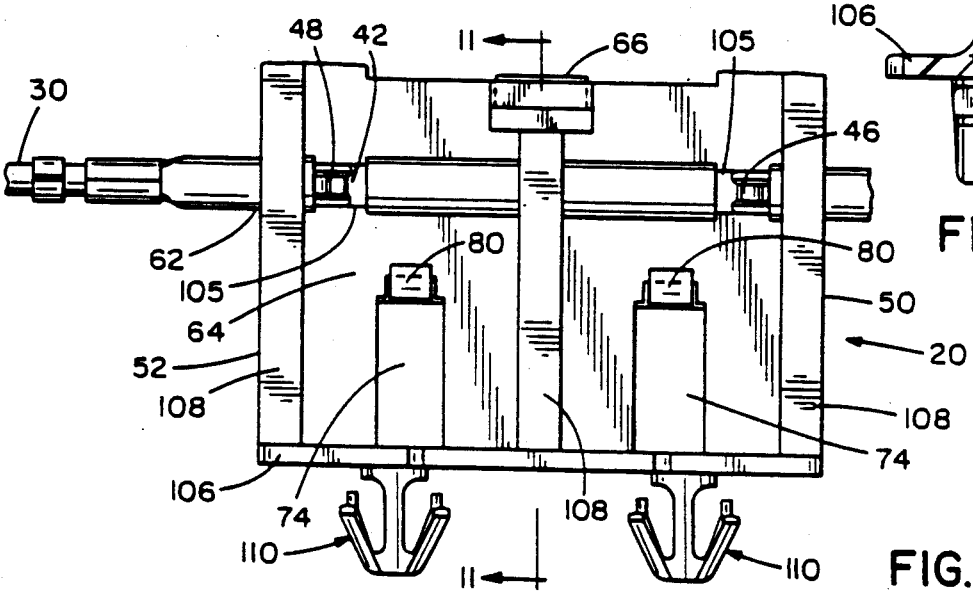
FIG. 10 is a rear elevational view of the holder carrying the switch and a pair of the terminal elements.

Referring now to the drawings, a reed switch holder assembly embodying various aspects of the present invention is generally indicated by reference numeral 20 in FIGS. 1, 10 and 11. The assembly 20 includes a holder 18 of molded thermoplastic construction which, in its as-molded condition (FIGS. 6–9), is integral. The assembly further includes a reed switch 22 having an elongate glass envelope 24 of either circular cross section (FIG. 2) or rectangular cross section (FIG. 3) which is firmly supported by the holder, and a pair of terminal elements 26 for joining the leads 28 of the reed switch with the metallic cores of insulated conductors 30 for interconnecting the reed switch with other circuitry components. The reed switch holder assembly 20 finds particular application for use in monitoring the rpm of a motor for a garage door operator. As shown in greatly simplified form in FIG. 1, the reed switch 22 can be used to sense the number of revolutions of the shaft 32 of a motor 34 which directly drives the garage door between fully open and fully closed positions. The shaft is shown carrying an actuating cylinder 36 having an actuating magnet 38 positioned on the periphery of the cylinder. Thus the reed switch 22, held by the holder 18 which is in turn retained on a mounting wall 40 which could be part of the operator housing, provides a switched output each time the magnet 38 passes the switch.

More specifically, the terminal elements 26 each include a switch lead-receiving ferrule 42 and a crimpable barrel portion 44 for mechanical and electrical connection to the core of a conductor 30 from which the insulated jacket has been stripped away. The ferrule has a spring finger 46 for pushing a reed switch lead 28 against the floor of the ferrule to establish good electrical connection therebetween, and includes a finger bight portion 48 extending transversely from the remainder of the ferrule. Such a metallic terminal element could be made of bronze with a tin finish, and is available from AMP Incorporated of Harrisburg, PA, under the name of stator terminal amplivar, Part. No. 62763-1.

The reed switch holder 18, shown in its as-molded condition in FIGS. 6–9, is integrally formed of a thermoplastic material, a preferred material being Delrin, a registered trademark of DuPont for polyacetal resin, Part No. 500 NC-10. The holder 18, which has a first end 50 and a second end 52, includes a base 54 and a cover 56 joined by a pair of spaced hinge sections 58. The cover 56 can be rotated about the hinge sections 58 from the as-molded condition of the holder toward an assembled condition of the holder, shown in FIGS. 1, 10 and 11, in which the cover overlies the base to define a central cavity 60 for holding the envelope 24 of the reed switch 22. In its assembled condition the holder also includes a pair of side cavities 62, aligned with the central cavity 60 extending between holder ends 50 and 52, for receiving the reed switch leads 28 and the lead-receiving ferrules 42 of the terminal elements 26. One side cavity 62 extends to the holder first end 50 while the other side cavity 62 extends to the holder second end 52.

Holder 18 also includes latch means for maintaining the cover 56 and base 54 in their assembled condition. More particularly, the base has a vertically extending wall 64 at its upper end having an arcuate hook support 66 for entrance into an opening 68 adjacent the bottom of the cover to guide relative rotational movement of the cover and base toward their assembled condition. Depending on the elasticity of the type of thermoplastic material from which the holder is formed, the hinge sections 58 may rupture as the cover is rotated from the as-formed condition. However the concave inside surface 70 of the hook support bearing on the convex surface 72 defining the opening 68 guides the cover toward the assembled condition of the holder. The latch means includes a pair of spaced apertures 74 formed in the vertical wall 64 with each aperture being partially defined by a catch 76 at the upper end of the aperture. At its upper end, the cover carries spaced, outwardly extending latch arms 78 each terminating in a latching tooth 80 for abutting a corresponding catch 76 when the base and the cover are in their assembled condition.

The base 54 has an inside surface 82 and the cover has an inside surface 84. These surfaces have aligned depressions forming the central cavity 60 and the side cavities 62. More particularly, the base surface 82 includes a central depression 86 in which are disposed, as best shown in FIG. 9, a pair of recessed ledges 88 spaced by an arcuate concave surface 90. Similarly, the cover surface 84 includes a central depression 92 in which are positioned a pair of recessed ledges 94 spaced by an arcuate concave surface 96. As shown in FIG. 11, when the reed switch 22 has an envelope 24 of circular cross section, the concave surfaces 90 and 96 serve to seat the envelope of the reed switch. On the other hand if reed switch 22A, having an envelope 24A of generally rectangular cross section, is to be employed in the reed switch holder assembly, the four ledges 88 and 94 function to seat the envelope. Thus the holder 18 can accommodate either type of reed switch and still protect the fragile glass envelope.

The base inside surface 82 also includes side depressions 98 flanking the central depression 86 and separated therefrom by ridges 100. The cover inside surface 84 also has side depressions 102 flanking the central depression 92 and spaced therefrom by ridges 104. Corresponding side depressions 98 and 102 of the base and cover, respectively, define each side cavity when the holder is in its assembled condition. The ridges 100 and 104 abut the ends of the envelope 24 to retain the switch in the holder. Furthermore, the leads 28 may be compressively held between corresponding ridges 100 and 104. The vertical wall 64 of the base 54 includes a window 105 extending transversely from each base side depression 98 for holding the finger bight portion 48 of a corresponding terminal element 26. With the bight portion 48 extending into the window, the terminal element can only be removed from the holder by applying some withdrawal force.

The holder 18 also includes mounting means for attaching the holder assembly to a support such as the wall 40 shown in FIG. 1. The holder mounting means includes a generally horizontal bottom wall 106 at the bottom of the vertical wall 64 of the base 54. A trio of regularly spaced triangular reinforcing ribs 108 join the bottom wall 106 and the vertical wall 64. Dependent from the bottom wall 106 are a pair of anchor mounts 110 for insertion through holes of predetermined diameter formed in the wall 40. Each anchor mount includes a positioning disc 112 of smaller diameter than the insertion hole, a stem 114 and a pair of barbs 116 with the base ends of the barbs 116 joined to the disc by the stem. The resilient barbs diverge upwardly and have distal ends 118 spaced apart a greater distance than the diameter of the insertion hole. Each barb distal end 118 is provided with an upstanding tang 120 for bearing on the surface defining the insertion hole to, in cooperation with the disc 112, resist lateral movement of the holder after being mounted on the wall 40.

Operation of the reed switch holder assembly 20 of the present invention is as follows: In one method of use, the reed switch 22 is placed in the depressions 86 and 98 of the base 94. Thereafter the cover 56 can be rotated about the hinge sections 58 causing the hook support 66 of the base to enter into the opening 68 of the cover. This guides further rotation of the cover until the latch arms 78 of the cover enter into the apertures 74 of the base. Further rotation causes the latching teeth 80 to engage the catches 76 to lock the base and cover in their assembled condition with the envelope 24 of the reed switch disposed in the central cavity 60 of the holder and the leads 28 extending into their respective side cavities 62 of the holder. The user can strip the insulation from the end of a conductor and crimp the crimp ferrule 44 to that conductor core. Thereafter, the terminal elements can be aligned with the holder and the lead-receiving ferrule 42 of each terminal element 26 inserted into the assembled holder from either end 50 or 52. Movement of the terminal element into the holder causes the lead 28 to deflect its corresponding reversely folded spring finger 46 thereby establishing good electrical contact between the lead and the terminal element. Continued insertion results in the finger bight portion 48 deflecting apart the cover and base until the bight portion becomes aligned with and received in the corresponding window 105 thereby allowing the base and cover to return toward their assembled condition resulting in the terminal element being maintained in the holder. Finally, the holder assembly is easily placed on the mounting wall by simply pushing the anchor mounts 110 into the insertion holes until the locking barbs 116 pass the underside of the wall at which time they return toward their as-formed condition having a greater separation than the diameter of the insertion hole.

The holder 18 offers great flexibility in use because not only can it accommodate either the reed switch 22 or the rectangular-bodied reed switch 22A, but it also permits the assembled holder to position the terminal elements 26 before their barrels 44 are crimped to the wires offering added convenience for the installer. Additionally, the holder can be used if it should be desired to crimp the ferrule 42 onto the lead 28 of the reed switch before moving the holder 18 from its as-formed condition t its assembled condition. Of course, if the lead-receiving ferrule employs only the spring finger 48 to engage the lead of the reed switch, the terminal element can be disconnected from the remainder of the reed switch holder assembly, if it should be so desired. Accordingly, the reed switch holder 18 offers great convenience in use, and does not require the installer to keep track of multiple loose holder parts.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A reed switch holder assembly for detecting the passage of a magnet adjacent the assembly and providing a switched output in response thereto, said assembly comprising:

a reed switch including an elongate insulative envelope in which are disposed first and second reeds, said switch further including a first lead electrically connected to said first reed and extending beyond one end of said envelope, and a second lead electrically connected to said second reed and extending beyond the other end of said envelope;

first and second metallic terminal elements each including a lead-receiving ferrule and a portion for mechanical and electrical connection to a conductor, said ferrule having a spring finger for holding a lead and including a finger portion extending transversely from the remainder of said ferrule, said spring finger being deflectable by a lead inserted into said ferrule; and a reed switch holder having a first end and a second end and including:

a base of one-piece molded thermoplastic construction, and a cover of one-piece molded thermoplastic construction, said base and cover comprising latch means for holding said base and cover assembled, said base and cover in their assembled condition defining a central cavity for holding said envelope and a pair of side cavities for receiving said leads and the lead-receiving ferrules of said terminal elements, one side cavity extending to said holder first end to permit insertion of the lead-receiving ferrule of said first terminal element into said one side cavity from said first end after said base and cover have been assembled holding said envelope in said central cavity, and the other side cavity extending to said holder second end to permit insertion of the lead-receiving ferrule of said second terminal element into said other side cavity from said second end after said base and cover have been assembled, said holder having a window extending transversely from at least one said side cavity for holding the finger portion of the corresponding ferrule and said holder including mounting means for mounting said assembly on a mounting wall, whereby after the base and cover are latched to hold the switch, the ferrule of the one terminal element can be inserted into said one side cavity so that its spring finger holds said one lead until the finger portion is received and held by the corresponding window.

2. A holder assembly as set forth in claim 1 wherein said holder is integrally formed, said holder further comprising a hinge joining said base and said cover.

3. A holder assembly as set forth in claim 2 wherein said hinge is positioned adjacent the top of said holder in its assembled condition, said mounting means being positioned adjacent the bottom of said holder and said holder ends extending between said top and said bottom.

4. A holder assembly as set forth in claim 1 wherein said base includes a wall extending from said mounting means, one of said wall and cover having an arcuate hook support and the other of said wall and cover having an opening for receiving said hook support so that said hook support can guide relative rotational movement between said wall and said cover, said cavities being disposed between said hook support and said latch means in the assembled condition of said holder.

5. A holder assembly as set forth in claim 4 in which said latch means includes an aperture partially defined by a catch, said aperture being in one of said wall and said cover, said latch means further including a latching arm extending from the other of said wall and said cover for reception in said aperture, said latching arm carrying a latching tooth abutting said catch when said base and cover are in their assembled condition.

6. A holder assembly as set forth in claim 1 wherein said base includes a depression partially defining said central cavity, said depression including a pair of ledges spaced by an arcuate concave surface.

7. A holder assembly as set forth in claim 6 in which the envelope of said reed switch has a circular cross section so that said concave surface seats said envelope.

8. A holder assembly as set forth in claim 6 in which the envelope of said reed switch is rectangular so that said ledges seat said envelope.

9. A holder assembly as set forth in claim 1 wherein said central cavity and said side cavities are aligned and have a common axis extending between said holder ends, said holder further comprising ridges spacing said central cavity from said side cavities, said ridges abutting the ends of said envelope in the assembled condition of said holder to retain said reed switch in said holder.

10. A reed switch holder as set forth in claim 1 wherein said holder has a said window extending transversely from each side cavity.

11. A reed switch holder of one-piece molded thermoplastic construction for retaining a reed switch of the type having an elongate envelope encapsulating a pair of metallic reeds and with leads extending from the ends of the envelope, said holder comprising:

a base having a top, a bottom and spaced first and second ends extending between said top and bottom;

a cover which in the as-molded condition of said holder extends away from said base;

a hinge joining said cover to the top of said base;

latch means for holding said cover overlying said base in an assembled condition of said holder, in said assembled condition said cover and said base having facing surfaces defining a central cavity for holding said envelope and side cavities flanking said central cavity for receiving the ferrules of terminal elements for electrical connection to said leads, said side cavities extending to respective ends of said base so that the ferrules of the terminal elements can be inserted into corresponding side cavities from corresponding base ends after the cover and base have been assembled and hold the reed switch, said holder further comprising a window opening onto and extending transversely of each side cavity for receiving and holding a ferrule component to retain said terminal elements in said holder; and mounting means disposed adjacent the bottom of said base for mounting said holder on a mounting surface.

* * * * *